US006752879B2

(12) United States Patent
Takaki et al.

(10) Patent No.: US 6,752,879 B2
(45) Date of Patent: Jun. 22, 2004

(54) RARE EARTH MAGNET AND METHOD FOR MANUFACTURING THE SAME

(75) Inventors: Shigeru Takaki, Amagasaki (JP); Ken Makita, Osaka (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 10/446,835

(22) Filed: May 29, 2003

(65) Prior Publication Data

US 2003/0205294 A1 Nov. 6, 2003

Related U.S. Application Data

(62) Division of application No. 09/961,536, filed on Sep. 24, 2001, now Pat. No. 6,648,984.

(30) Foreign Application Priority Data

Sep. 28, 2000 (JP) ..... 2000-295355

(51) Int. Cl.[7] ..... H01F 1/057
(52) U.S. Cl. ..... 148/302; 75/244
(58) Field of Search ..... 148/302; 75/244

(56) References Cited

U.S. PATENT DOCUMENTS

| | | | | |
|---|---|---|---|---|
| 4,588,439 A | * | 5/1986 | Narasimhan et al. | 148/302 |
| 4,601,875 A | * | 7/1986 | Yamamoto et al. | 419/23 |
| 4,793,874 A | | 12/1988 | Mizoguchi et al. | |
| 4,814,139 A | | 3/1989 | Tokunaga et al. | |
| 4,968,347 A | * | 11/1990 | Ramesh et al. | 75/244 |
| 4,975,129 A | * | 12/1990 | Fujimura et al. | 148/302 |
| 5,143,560 A | | 9/1992 | Doser | |
| 5,167,914 A | * | 12/1992 | Fujimura et al. | 419/11 |
| 5,194,099 A | * | 3/1993 | Esper et al. | 148/302 |
| 5,383,978 A | | 1/1995 | Yamamoto et al. | |
| 5,589,009 A | * | 12/1996 | Kim et al. | 148/302 |
| 5,788,782 A | | 8/1998 | Kaneko et al. | |
| 5,997,804 A | * | 12/1999 | Uchida et al. | 419/12 |

FOREIGN PATENT DOCUMENTS

| | | |
|---|---|---|
| EP | 0 295 779 | 12/1988 |
| EP | 0 651 401 | 5/1995 |
| JP | 63-033505 | 2/1988 |
| JP | 63-116404 | 5/1988 |
| JP | 4-114409 | 4/1992 |
| JP | 10-233306 | 9/1998 |
| JP | 2000-219942 | 8/2000 |
| JP | 2000-219943 | 8/2000 |

OTHER PUBLICATIONS

AP J. Bernardi et al., "Microstructural analysis of strip cast Nd–Fe–B alloys for high $(BH)_{max}$ magnets", American Institute of Physics (Jun. 1998).

AQ Y. Kaneko et al., "Recent Developments of High–Performance NEOMAX Magnets", Journal of Materials Engineering and Performance (Apr. 1994).

* cited by examiner

*Primary Examiner*—John Sheehan
(74) *Attorney, Agent, or Firm*—Keating & Bennett, LLP

(57) ABSTRACT

A compact is produced from an alloy powder for R—Fe—B type rare earth magnets including particles having a size in a range of about 2.0 μm to about 5.0 μm as measured by a light scattering method using a Fraunhofer forward scattering in a proportion of approximately 45 vol. % or more and particles having a size larger than about 10 μm in a proportion of less than about 1 vol. %. The compact is then sintered to obtain a R—Fe—B type rare earth magnet having an average crystal grain size in a range of about 5 μm to about 7.5 μm, and an oxygen concentration in a range of about 2.2 at. % to about 3.0 at. %.

2 Claims, 4 Drawing Sheets

RARE EARTH MAGNET AND METHOD FOR MANUFACTURING THE SAME

This application is a Divisional of U.S. patent application Ser. No. 09/961,536 filed Sep. 24, 2001, now U.S. Pat. No. 6,648,984.

BACKGROUND OF THE INVENTION

The present invention relates to R—Fe—B type rare earth magnets and alloy powder for such magnets, and methods for producing such magnets and alloy powder.

Rare earth sintered magnets are produced by pulverizing an alloy for rare earth magnets to form alloy powder, compacting the alloy powder, and subjecting the alloy powder to sintering and aging. Presently, as the rare earth sintered magnets, samarium-cobalt magnets and rare earth-iron-boron magnets, are extensively used in various fields. In particular, rare earth-iron-boron magnets (hereinafter, referred to as "R—Fe—B type magnets", where R is any rare earth element and/or Y, Fe is iron, and B is boron), which exhibit the highest magnetic energy product among a variety of magnets and have a comparatively low cost, have been extensively applied to various types of electronic equipment. Note that a transition metal element such as Co may be substituted for a portion of Fe and C (carbon) may be substituted for a portion of B (boron) in such R—Fe—B type magnets.

Powder of the material alloy for R—Fe—B type rare earth magnets may be produced by a method including a first pulverization process for coarsely pulverizing the material alloy and a second pulverization process for finely pulverizing the material alloy. In general, in the first pulverization process, the material alloy is coarsely pulverized to an average particle size that is several hundred micrometers or less using a hydrogen embrittlement apparatus. In the second pulverization process, the coarsely pulverized alloy (coarsely pulverized powder) is finely pulverized to an average particle size that is several micrometers with a jet mill or other suitable apparatus.

The material alloy can be produced by methods that are generally classified into two types. The first type of method is an ingot casting method where a molten material alloy is poured into a mold and cooled comparatively slowly. The second type of method is a rapid cooling method, typified by a strip casting method and a centrifugal casting method, where a molten material alloy is put into contact with a single chill roll, twin chill rolls, a rotary chill disk, a rotary cylindrical chill mold, or other similar device, to be rapidly cooled thereby producing a solidified alloy that is thinner than an ingot cast alloy.

In the rapid cooling method, the molten alloy is cooled at a rate in the range of $10^{2}$° C./sec to $10^{4}$° C./sec. The resultant alloy produced by the rapid cooling method has a thickness in the range of 0.03 mm to 10 mm. The molten alloy starts solidifying at the surface that comes into contact with a chill roll. From the roll contact surface, crystal grows in the thickness direction into the shape of pillars or needles. The resultant rapidly solidified alloy therefore has a fine crystal structure including portions of a $R_2T_{14}B$ crystal phase having a size in the range of 0.1 μm to 100 μm in the minor-axis direction and in the range of 5 μm to 500 μm in the major-axis direction, and portions of an R-rich phase dispersed at grain boundaries of the $R_2T_{14}B$ crystal phase portions. The R-rich phase is a nonmagnetic phase in which the concentration of any rare earth element R is relatively high, and has a thickness (which corresponds to the width of the grain boundaries) of 10 μm or less.

Because the rapidly solidified alloy is cooled in a relatively short time compared with an ingot alloy produced by a conventional ingot casting method, the alloy has a fine structure and small grain size. In addition, with finely dispersed crystal grains, the area of grain boundaries is wide, and thus the R-rich phase spreads thinly over the grain boundaries. This results in good dispersion of the R-rich phase.

When a rare earth alloy (especially a rapidly solidified alloy) is coarsely pulverized in a hydrogen embrittlement process where the rare earth alloy first occludes hydrogen (this way of pulverization is herein referred to as "hydrogen pulverization"), the R-rich phase portions existing at grain boundaries react with hydrogen and expand. Therefore, the alloy tends to start cracking from the R-rich phase portions (grain boundary portions). As a result, the R-rich phase tends to be exposed on the surfaces of particles of the rare earth alloy powder obtained by the hydrogen pulverization. In addition, in the case of a rapidly solidified alloy, where the R-rich phase portions are fine and highly dispersed, the R-rich phase particularly tends to be exposed on the surfaces of the hydrogen-pulverized powder. Such an R-rich phase that exists in the powder particle plays an important role during a sintering process of a powder compact. During the sintering process, the R-rich phase melts earlier than $R_2T_{14}B$ crystal phase to form a liquid phase which is needed for sintering the powder compact.

Based on experiments conducted by the present inventors, when the coarsely pulverized powder in the above-described state is finely pulverized with a jet mill or other suitable apparatus, R-rich super-fine powder (fine powder having a particle size of 1 μm or less) is produced. Such R-rich super-fine powder particles oxidize very easily compared with other powder particles (having a relatively large particle size) that contain a relatively smaller amount of R. Therefore, if a sintered magnet is produced from the resultant finely pulverized powder without removing such R-rich super-fine powder, oxidation of the rare earth element rapidly proceeds during the manufacturing process steps. The rare earth element R is thus consumed by reacting with oxygen, and as a result, the production amount of the $R_2T_{14}B$ crystal phase as the major phase significantly decreases. This results in a decrease in the coercive force and remanent flux density of the resultant magnet and deterioration of the square-ness of the demagnetization curve, which is the second quadrant curve of the hysteresis loop.

In order to prevent oxidation of the R-rich finely pulverized powder, the entire process from pulverizing through sintering may ideally be performed in an inert atmosphere. It is however very difficult to realize this environment in a mass-production scale in production facilities.

A method for solving the above-described problem has been proposed, where fine pulverization is performed in an inert atmosphere containing a trace amount of oxygen, to intentionally coat the surfaces of finely pulverized powder particles with a thin oxide film to thereby suppress fast oxidation of the powder particles in the atmosphere.

However, the method described in the preceding paragraph causes a problem as follows when the powder particle size is simply reduced for the purpose of enhancing the coercive force. When the particle size is reduced, the total surface area of particles existing in a given weight of powder increases. This increases the total oxygen amount adsorbed to the surfaces of the powder particles, and as a result, the oxygen concentration of the resultant sintered magnet becomes significantly high. Since oxygen contained in the sintered magnet reacts with the rare earth element R, the amount of the produced $R_2T_{14}B$ crystal phase as the major phase is significantly reduced. As a result, the coercive force decreases contrary to the original purpose.

In general, in order to enhance the coercive force, it is considered necessary to reduce the grain size of the $R_2T_{14}B$ crystal phase as the major phase to a size closer to the mono-domain grain size (about 0.5 μm). However, the surfaces of the powder particles must be thinly oxidized to avoid the risk of ignition, and this results in decreasing the coercive force, as described above. Therefore, for enhancing the coercive force, simply reducing the powder particle size is not enough. As countermeasures, an expensive rare element such as Dy and Tb that are effective in enhancing the coercive force may be added.

However, addition of such an expensive rare element raises the price of the magnet, and thus may threaten stable supply of magnets. There are therefore strong demands for providing rare earth magnets that exhibit an increased coercive force but do not contain expensive rare elements such as Dy.

SUMMARY OF THE INVENTION

In order to solve the problems described above, preferred embodiments of the present invention provide a method for manufacturing a R—Fe—B type rare earth magnet that greatly increases the coercive force thereof while avoiding occurrence of oxidation/ignition due to contact with the atmosphere, also provide a high-performance R—Fe—B type rare earth magnet manufactured by such a novel method.

According to a preferred embodiment of the present invention, a method for manufacturing R—Fe—B type rare earth magnets includes the steps of preparing alloy powder for R—Fe—B type rare earth magnets including particles having a size in a range of about 2.0 μm to about 5.0 μm as measured by a light scattering method using a Fraunhofer forward scattering in a proportion of about 45 vol. % or more and particles having a size larger than about 10 μm in a proportion of less than about 1 vol. %; compacting the powder to produce a compact; and sintering the compact.

Preferably, in the step of sintering, a sintered magnet having an average crystal grain size in a range of about 5 μm to about 7.5 μm is produced.

The concentration of oxygen contained in the sintered magnet is preferably adjusted to be in a range of about 2.2 at. % to about 3.0 at. %.

Preferably, the alloy powder for R—Fe—B type rare earth magnets includes substantially no Dy.

In another preferred embodiment of the present invention, the step of preparing alloy powder for R—Fe—B type rare earth magnets includes a first pulverization step of coarsely pulverizing a material alloy for rare earth magnets produced by a rapidly cooling method and a second pulverization step of finely pulverizing the material alloy, wherein in the second pulverization step, the material alloy for R—Fe—B type rare earth magnets is pulverized in a chamber of a pulverizer filled with inert gas containing an oxidizing gas.

Preferably, a classifier is connected to follow the pulverizer for classifying powder coming out from the pulverizer.

In another preferred embodiment of the present invention, the material alloy for rare earth magnets is obtained by cooling a molten material alloy at a cooling rate in a range of about $10^{2}$° C./sec to about $10^{4}$° C./sec.

The molten material alloy is preferably cooled by a strip casting method.

The R—Fe—B type rare earth magnet of various preferred embodiments of the present invention has an average crystal grain size in a range of about 5 μm to about 7.5 μm, and an oxygen concentration in a range of about 2.2 at. % to about 3.0 at. %.

Preferably, alloy powder as a material of the R—Fe—B type rare earth magnet includes substantially no Dy.

Other features, processes, steps, characteristic and advantages of the present invention will become more apparent from the following detailed description of preferred embodiments of the present invention with reference to the attached drawings.

DETAILED DESCRIPTION OF THE INVENTION

Figure 1:
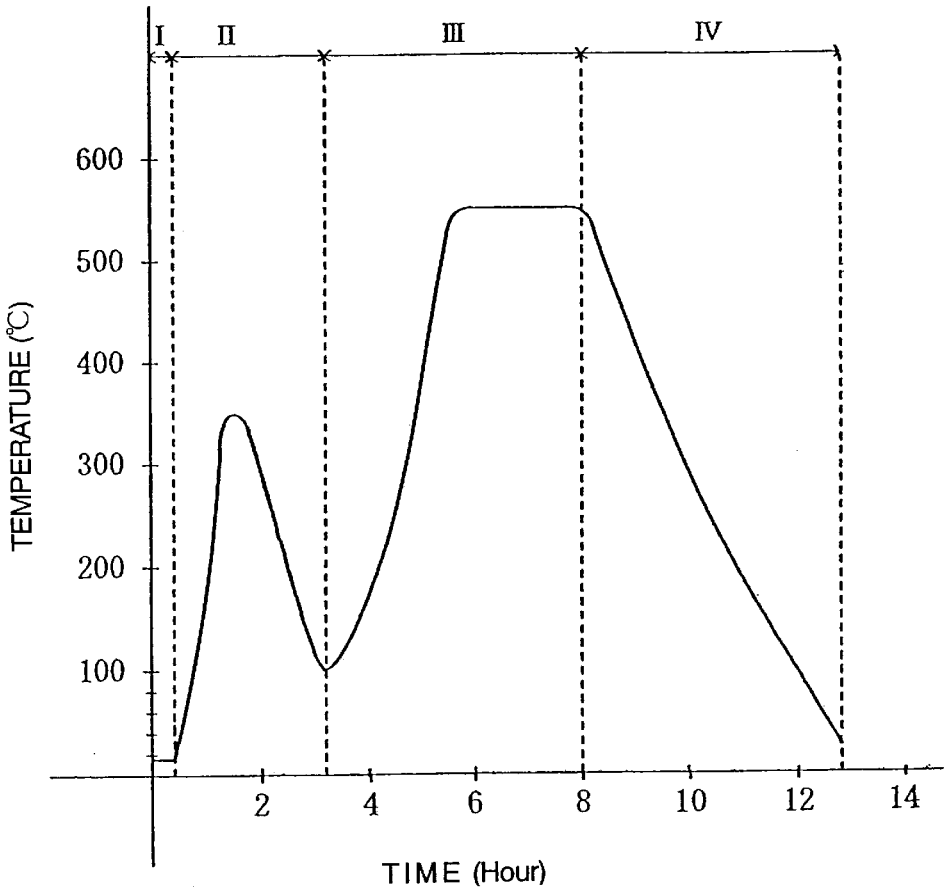
FIG. 1 is a graph showing an exemplary temperature profile in the hydrogen pulverization performed in the rough pulverization process according to preferred embodiments of the present invention.

The present inventors have discovered that when alloy powder for R—Fe—B type rare earth magnets having the following particle size distribution is used to produce a sintered magnet, occurrence of oxidation/ignition of the powder due to contact with the atmosphere is prevented, and moreover, a high coercive force that is attainable by adding Dy is achieved although the powder contains substantially no Dy. That is, the powder preferably includes particles having a size in the range of about 2.0 μm to about 5.0 μm in a proportion of approximately 45 vol. % or more and particles having a size of about 10 μm or more only in the proportion of less than about 1 vol. %. The present invention has been conceived based on the above-described findings. As used herein, the term of "containing substantially no Dy" refers to a case that the Dy concentration is about 0.1 at. % (atomic percent) or less of the entire alloy.

According to preferred embodiments of the present invention, the concentration of oxygen contained in the sintered magnet is adjusted to be in the range of about 2.2 at. % to about 3.0 at. %. By making such an adjustment, the particle surfaces of the alloy powder for R—Fe—B type rare earth magnets having the particle size distribution described above can be optimally oxidized, and yet the coercive force is prevented from being decreased due to the oxygen contained.

The average particle size of the alloy powder for R—Fe—B type rare earth magnets used in preferred embodiments of the present invention is significantly small compared with that of alloy powder for R—Fe—B type rare earth magnets actually used for mass-production of R—Fe—B type rare earth magnets. This enables use of a comparatively low temperature throughout the sintering process, and as a result, the average crystal grain size of the finally-produced sintered magnets can be substantially reduced compared with that of the conventional magnets. This effect, combined with the effect obtained by the optimized oxygen content, greatly contributes to achieving a significant increase in the coercive force.

According to preferred embodiments of the present invention, particles having a size larger than about 10 μm as measured by the light scattering method using a Fraunhofer forward scattering are removed from the powder. It has been confirmed based on experiments that the existence of such large particles in the proportion of about 1 vol. % or more causes a decrease in the remanent flux density and the maximum magnetic energy product.

As described above, the powder includes particles having a size falling within a comparatively narrow range of about 2.0 μm to about 5.0 μm as measured by the light scattering method using forward scattering in the proportion of approximately 45 vol. % or more of the entire powder. This means that the particle size distribution of this powder is significantly sharp. It has been confirmed by experiments conducted by the present inventors that if the particle size distribution of powder is broad, the coercive force of the resultant sintered magnet decreases even when the average particle size of the powder is small. For further enhancement of the coercive force, powder is preferably adjusted so that particles having a size in the range of about 2.0 μm to about 5.0 μm occupy about 50 vol. % or more of the entire powder. In preferred embodiments of the present invention, also, R-rich super-fine powder (particle size: approximately 1 μm or less) is adjusted to occupy about 5 vol. % or less of the entire powder.

According to preferred embodiments of the present invention, after a material alloy for rare earth magnets is coarsely pulverized and before fine pulverization is finished, R-rich super-fine powder particles and large-size particles are removed as much as possible, to produce powder having the particle size distribution described above.

The concentration of the rare earth element R in the R-rich superfine powder is higher than the average concentration of R in the entire powder. Therefore, the removal of even a portion of the R-rich super-fine powder may reduce the concentration of R in the entire powder. Reduction in the concentration of the rare earth element R might appear disadvantageous at first glance, since the rare earth element R is indispensable not only for the $R_2T_{14}B$ crystal phase as the major phase providing hard magnetism but also for liquid phase formation in a sintering process. However, the rare earth element R contained in the super-fine powder removed will otherwise be consumed for reacting with oxygen and will not significantly contribute to generation of the $R_2T_{14}B$ crystal phase and the liquid phase in a sintering process. Therefore, by removing the R-rich super-fine powder, the amount of oxygen contained in the powder can eventually be reduced. This results in a significant increase in the amount of the $R_2T_{14}B$ crystal phase contained in the resultant sintered magnet, and thus, greatly improves the magnetic properties of the magnet.

According to experiments conducted by the present inventors, the R-rich super-fine powder is apt to be produced when a rapidly solidified alloy such as a strip cast alloy is pulverized, and it is also apt to be produced when the hydrogen pulverization method is used for coarse pulverization, as described above. Therefore, in one of the preferred embodiments of the present invention to be described hereinafter, the case that a rapidly solidified alloy is coarsely pulverized by the hydrogen pulverization method and then finely pulverized will be taken as an example. In addition, when a jet mill is used to perform fine pulverization under a high-speed flow of inert gas, a gas flow classifier using centrifugal force and a classifier rotor may be provided to enable effective removal of R-rich super-fine powder (particle size: approximately 1 μm or less) and large particles having a size of about 10 μm or more from finely pulverized powder carried in the gas flow. In the following preferred embodiments, therefore, a jet mill is preferably used for fine pulverization.

Hereinafter, preferred embodiments of the present invention will be described with reference to the accompanying drawings.

Material Alloy

First, a material alloy for R—Fe—B magnets having a desired composition is prepared by a known strip casting method and stored in a container. Specifically, an alloy having a composition of about 8 at. % (atomic percent) to about 30 at. % of Nd, about 2 at. % to about 28 at. % of B, and Fe as the balance with inevitably contained impurities is melted by high-frequency melting, to form a molten alloy. The alloy may also include Al, Ti, Cu, V, Cr, Ni, Ga, Zr, Nb, Mo, In, Sn, Hf, Ta, W, and other suitable material. The molten alloy is preferably kept at about 1350° C. and then cooled by a single chill roll method, to obtain alloy strips or flakes having a thickness of about 0.3 mm. The cooling process is preferably performed under the conditions of a roll circumferential velocity of about 1 m/sec, a cooling rate of about 500° C./sec, and subcooling to about 200° C. The thus-produced rapidly solidified alloy is crushed to smaller flakes having a size of about 1 mm to about 10 mm before being subjected to hydrogen pulverization. Production of a material alloy by the strip casting method is disclosed in U.S. Pat. No. 5,383,978, for example.

First Pulverization Process

The coarsely crushed material alloy flakes are then filled in a plurality of material packs made of stainless steel, the packs are put on a rack, and the rack is placed in a hydrogen furnace. The hydrogen furnace is then covered with a lid to start the hydrogen pulverization process according to a temperature profile shown in FIG. 1, for example. In the example shown in FIG. 1, an evacuation step I is first executed for approximately 0.5 hours, followed by a hydrogen occlusion step II for approximately 2.5 hours. In the hydrogen occlusion step II, hydrogen gas is fed into the furnace to produce a hydrogen atmosphere inside the furnace. The hydrogen pressure at this time is preferably about 200 kPa to about 400 kPa.

Subsequently, a dehydrogenation step III is executed under a reduced pressure of about 0 Pa to about 3 Pa for approximately 5.0 hours, and then a material alloy cooling step IV is performed for approximately 5.0 hours while feeding argon gas into the furnace.

From the aspect of cooling efficiency, the cooling step IV is preferably performed in the following manner. When the temperature of the atmosphere in the furnace is still comparatively high in the cooling step IV (for example, when it is more than about 100° C.), the inert gas having an ordinary temperature is fed into the furnace for cooling. When the temperature of the material alloy drops to a comparatively low level (for example, when it is about 100° C. or less), the inert gas cooled to a temperature lower than the ordinary temperature (for example, a temperature lower than room temperature by about 10° C.) is fed into the furnace. Argon gas may be fed at a volume flow rate of about 10 $m^3$ to about 100 $m^3$ per minute.

Once the temperature of the material alloy drops to as low as about 20° C. to 25° C., the inert gas having roughly the ordinary temperature (a temperature lower than room temperature by about 5° C. or less) is fed into the hydrogen furnace until the temperature of the material alloy reaches the ordinary temperature level. By following the above-described procedure, it is possible to avoid occurrence of condensation inside the furnace when the lid of the hydrogen furnace is opened. If water exists inside the furnace due to condensation, the water will be frozen/vaporized in the evacuation process. This makes it difficult to increase the degree of vacuum and thus disadvantageously increases the time required for the evacuation step I.

After the hydrogen pulverization, the coarsely pulverized alloy powder should preferably be taken out from the hydrogen furnace in an inert gas atmosphere so as not to be in contact with the atmosphere. This prevents oxidation/heat generation of the coarsely pulverized powder and thus, improves the magnetic properties of the resultant magnet. The coarsely pulverized material alloy is then filled in a plurality of material packs, and the packs are put on a rack.

As a result of the hydrogen pulverization, the rare earth alloy is pulverized to a size in the range of about 0.1 mm to about several millimeters with an average particle size of about 500 $\mu$m or less. After the hydrogen pulverization, the embrittled material alloy is preferably further cracked to a finer size and cooled with a cooling apparatus such as a rotary cooler. In the case of taking out the material while the temperature of the material is still comparatively high, the cooling time with the rotary cooler or other suitable device may be made relatively longer.

Second Pulverization Process

Next, the coarsely pulverized powder produced in the first pulverization process is finely pulverized (or milled) preferably with a jet mill. To the jet mill used in this preferred embodiment, a cyclone classifier is connected for removal of super-fine powder.

Hereinafter, the fine pulverization process (second pulverization process) using the jet mill will be described in detail with reference to FIG. 2.

Figure 2:
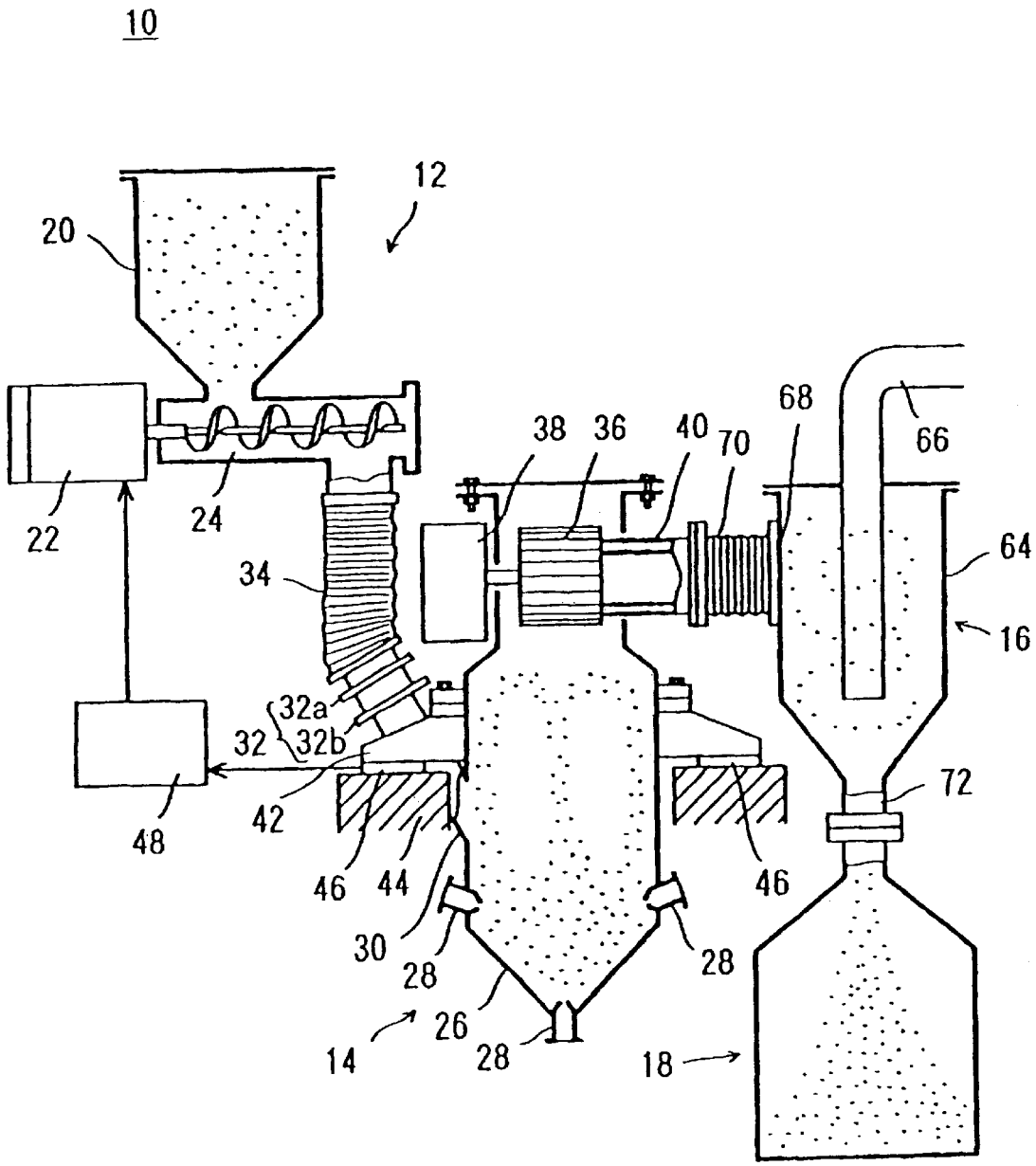
FIG. 2 is a cross-sectional view of a jet mill suitably used in the fine pulverization process according to preferred embodiments of the present invention.

The jet mill unit 10 shown in FIG. 2 preferably includes a material feeder 12 for feeding the rare earth alloy that was coarsely pulverized in the first pulverization process, a pulverizer 14 for pulverizing the material to be pulverized that is fed from the material feeder 12, a cyclone classifier 16 for classifying powder obtained by pulverizing the material to be pulverized with the pulverizer 14, and a collecting tank 18 for collecting powder having a predetermined particle size distribution classified with the cyclone classifier 16.

The material feeder 12 includes a material tank 20 for receiving the material to be pulverized, a motor 22 for controlling the feed amount of the material to be pulverized from the material tank 20, and a spiral screw feeder 24 connected to the motor 22.

The pulverizer 14 includes a vertically-mounted roughly cylindrical pulverizer body 26. In the bottom portion of the pulverizer body 26, a plurality of nozzle fittings 28 are arranged to receive nozzles through which an inert gas (for example, nitrogen) is transmitted at high speed. A material feed pipe 30 is connected to the pulverizer body 26 at the sidewall thereof for feeding the material to be pulverized into the pulverizer body 26.

The material feed pipe 30 is provided with a pair of valves 32, including an upper valve 32*a* and a lower valve 32*b*, for holding the material to be fed temporarily and confining the pressure inside the pulverizer 14. The screw feeder 24 and the material feed pipe 30 are coupled with each other via a flexible pipe 34.

The pulverizer 14 also includes a classifying rotor 36 placed in the upper portion of the pulverizer body 26, a motor 38 placed outside the upper position of the pulverizer body 26, and a connection pipe 40 extending through the upper portion of the pulverizer body 26. The motor 38 drives the classifying rotor 36, and the connection pipe 40 discharges the powder classified with the classifying rotor 36 outside the pulverizer 14. By the function of the classifying rotor 36, the powder from which large particles having a size larger than about 10 $\mu$m is removed is sent to the cyclone classifier 16.

The pulverizer 14 includes a plurality of support legs 42, and is secured to a base 44 surrounding the pulverizer 14 with the legs 42 attached to the base 44. In this preferred embodiment, weight detectors 46 such as load cells are placed between the legs 42 and the base 44. Based on the outputs from the weight detectors 46, a control section 48 controls the rotational speed of the motor 22 to thereby control the feed amount of the material to be pulverized.

The cyclone classifier 16 includes a classifier body 64 and an exhaust pipe 66 extending downward in the classifier body 64 from above. An inlet 68 is formed at the sidewall of the classifier body 64, to connect the classifier body 64 with the connection pipe 40 through a flexible pipe 70 for receiving the powder classified with the classifying rotor 36. An outlet 72 is provided at the bottom of the classifier body 64, to connect the classifier body 64 with the collection tank 18 for collection of finely pulverized powder.

The flexible pipes 34 and 70 are preferably made of resin or rubber, or made of a highly rigid material constructed in an accordion or coil shape to provide flexibility. By using such flexible pipes 34 and 70, changes in the weights of the material tank 20, the screw feeder 24, the classifier body 64, and the collecting tank 18 are not transferred to the legs 42. This enables an accurate detection of the weight of the material to be pulverized remaining in the pulverizer 14, as well as a change of the weight, with the weight detectors 46 placed on the legs 42. In this way, the amount of the material to be fed into the pulverizer 14 can be precisely controlled.

Next, the pulverization with the jet mill 10 will be described.

First, the material to be pulverized is put into the material tank 20, for being fed to the pulverizer 14 through the screw feeder 24. The feed amount of the material to be pulverized can be regulated by controlling the rotational speed of the motor 22. The material fed from the screw feeder 24 is temporarily held at the valves 32. The upper and lower valves 32*a* and 32*b* open and close alternately. Specifically, when the upper valve 32*a* is open, the lower valve 32*b* is closed. When the upper valve 32*a* is closed, the lower valve 32*b* is open. By this alternate open/close operation of the pair of valves 32*a* and 32*b*, the pressure inside the pulverizer 14 is prevented from leaking to the material feeder 12. In this way, when the upper valve 32*a* is open, the material to be pulverized is held between the pair of upper and lower valves 32*a* and 32*b*, and when the lower valve 32*b* is open, the material to be pulverized is guided through the material feed pipe 30 to be introduced into the pulverizer 14. The valves 32 are driven at high speed with a sequence circuit (not shown) provided separately from the control circuit 48 so that the material to be pulverized is sequentially fed into the pulverizer 14.

The material to be pulverized fed into the pulverizer 14 is rolled up with high-speed jets of inert gas from the nozzle fittings 28 and swirl together with high-speed gas flows inside the pulverizer 14. While swirling, the particles of the material are finely milled by colliding with each other.

Powder particles that are finely pulverized as described above are guided upward with ascending gas flows to reach the classifying rotor 36, where the particles are classified with gas flows and coarse particles are dropped for further pulverization. Particles having a size of a desired value or less pass through the connection pipe 40 and the flexible pipe 70 to be introduced into the classifier body 64 of the cyclone classifier 16 via the inlet 68. Inside the classifier body 16, relatively large powder particles having a size of a predetermined value or more drop to be accumulated in the collecting tank 18 placed under the classifier body 64, while super-fine powder particles are discharged together with the inert gas flows through the exhaust pipe 66. In this preferred embodiment, by removing the super-fine powder through the exhaust pipe 66, the particle quantity of the super-fine powder (particle size of approximately 1 $\mu$m or less) is preferably adjusted to about 10% or less than that of the entire powder collected in the collecting tank 18. By removing the R-rich super-fine powder in this manner, it is possible to reduce the amount of the rare earth element R in the resultant sintered magnet that will be consumed for reacting with oxygen, and thus improve the magnet properties.

As described above, in this preferred embodiment, the cyclone classifier 16 having the blowing-up function is preferably used as the centrifugal classifier placed following the jet mill (pulverizer 14). In the cyclone classifier 16 of this type, super-fine powder having a particle size of a predetermined value or less turns upward without being collected into the collecting tank 18 and is discharged outside through the pipe 66.

The particle size of the fine powder to be discharged through the pipe 66 can be controlled by appropriately determining cyclone parameters as those defined in "Powder technology pocketbook", Kogyo Chosakai Publishing Co., Ltd., pp. 92–96 and regulating the pressure of the inert gas flows.

In addition, by reducing the feed amount of the material and increasing the rotational speed of the classifying rotor 36, the particle size of the finally-obtained powder can be reduced, so that a desired particle size distribution is obtained.

In this preferred embodiment, it is possible to obtain powder in which particles having a size in the range of about 2.0 $\mu$m to about 5.0 $\mu$m as measured by the light scattering method using a Fraunhofer forward scattering occupy about 45 vol. % to about 80 vol. % of the entire powder and particles having a size larger than about 10 $\mu$m occupy less than about 1 vol. % of the entire powder. It is also possible to obtain alloy powder in which super-fine powder particles having a size of about 1.0 $\mu$m or less occupy about 5 vol. % or less of the total particle quantity of the powder.

In order to control the degree of oxidation in the pulverizing process to be within an appropriate range, the oxygen amount in the high-speed flow gas used during the fine pulverization is preferably adjusted to about 5000 ppm to about 50000 ppm by volume. A fine pulverization method including control of the oxygen concentration in the high-speed flow gas is described in Japanese Patent Examined Publication No. 6-6728, for example.

By controlling the concentration of oxygen contained in an atmosphere for the fine pulverization as described above, the oxygen content of the finely-pulverized alloy powder is preferably adjusted to about 0.8 to about 4.0 at. % (about 2000 to about 10000 ppm by weight). If the oxygen content of the rare earth alloy powder exceeds 4.0 at. % (10000 ppm by weight), the percentage of nonmagnetic oxides in the resultant sintered magnet increases, resulting in deteriorating the magnetic properties of the sintered magnet. If the oxygen content of the powder is excessively low, the powder tends to react with oxygen in the atmosphere and be oxidized after the pulverization. In this case, also, the oxygen concentration in the finally-produced sintered magnet increases.

In this preferred embodiment, the second pulverization process is performed preferably using the jet mill 10 constructed as shown in FIG. 2. The present invention is not limited to this, but a jet mill having another construction or another type of pulverizer (for example, a ball mill and a vibrating mill) may also be used. As the classifier for removing super-fine powder, a centrifugal classifier such as a FATONGEREN type classifier and a micro-separator may also be used instead of the cyclone classifier.

Addition of Lubricant

In this preferred embodiment, the finely pulverized powder produced in the manner described above is preferably mixed with a lubricant in an amount of about 0.3 wt %, for example, in a rocking mixer, so that the alloy powder particles are coated with the lubricant. As the lubricant, a fatty ester diluted with a petroleum solvent may be used. In this preferred embodiment, methyl caproate is preferably used as the fatty ester and isoparaffin is preferably used as the petroleum solvent. The weight ratio of methyl caproate to isoparaffin is preferably about 1:9, for example. Such a liquid lubricant provides the effect of preventing the powder particles from being oxidized by coating the surfaces of the particles, and the function of improving the degree of alignment of the powder particles during compaction and the degree of powder compaction (that is, forming a compact with a uniform density having no defects such as fractures and cracks).

The type of the lubricant is not limited to that described above. As the fatty ester, methyl caprylate, methyl laurylate, methyl laurate, and other suitable materials may be used in place of methyl caproate. As the solvent, petroleum solvents other than isoparaffin and naphthenic solvents, and other suitable solvents may be used. The lubricant may be added at any time before, during, or after the fine pulverization using the jet mill. In place of or in addition to the liquid lubricant, a solid (dry) lubricant such as zinc stearate may be used.

Compaction

The magnetic powder produced by the method described above is compacted in a magnetic field for alignment using a known press. Upon completion of the compaction, a powder compact is ejected upward with a lower punch to be taken out from the press. Using the alloy powder described above, the compaction can be performed in the atmosphere.

The compact is then placed on a sintering bedplate made of molybdenum, for example, and mounted in a sintering case together with the bedplate. The sintering case including the compact is moved to a sintering furnace, where the compact is subjected to a known sintering process to produce a sintered body. The sintered body is then subjected to aging, surface polishing, and deposition of a protection film, as required.

In this preferred embodiment, since the powder to be compacted includes only a small amount of R-rich super-fine powder that easily oxidizes, heat generation and ignition due to oxidation are not likely to occur immediately after the compaction. Thus, the removal of R-rich super-fine powder contributes to the improvement in magnetic properties and improvement in safety.

EXAMPLE AND COMPARATIVE EXAMPLE

As an example of preferred embodiments of the present invention, a raw material having a composition of about 13 at. % to about 15 at. % of a rare earth element R, about 6 at. % to about 7 at. % of boron (B), and Fe as the balance was finely pulverized with the jet mill connected with the cyclone classifier described above, to produce various samples A to L. These powder samples were evaluated for the particle size distribution and the oxygen amount. The results are shown in Table 1 below.

TABLE 1

| | Powder | | | | | | |
|---|---|---|---|---|---|---|---|
| | Particle size | | | | Composition | | |
| Sample | FSSS/$D_{50}$ ($\mu$m) | 1 $\mu$m or less (%) | 2 $\mu$m–5 $\mu$m (%) | 10 $\mu$m or more (%) | Nd (at %) | Dy (at %) | Oxygen amount (at %/ppm) |
| A | 2.1/3.2 | <1 | 68 | 0 | 14 | 0 | 2.48/6200 |
| B | 3.1/5.0 | 3 | 38 | 4 | 14 | 0 | 1.72/4300 |
| C | 3.1/5.0 | 3 | 38 | 4 | 13 | 1 | 1.72/4300 |
| D | 2.1/3.2 | <1 | 68 | 0 | 14 | 0 | 2.48/6200 |
| E | 2.2/3.7 | 4 | 56 | 0 | 14 | 0 | 2.32/5800 |
| F | 2.4/3.8 | 3 | 51 | 0 | 13 | 0 | 2.00/5000 |
| G | 2.5/4.0 | 2 | 48 | 0 | 14 | 0 | 1.92/4800 |
| H | 2.7/4.3 | 3 | 45 | 0 | 13 | 0 | 1.84/4600 |
| I | 2.9/4.8 | 3 | 42 | 2 | 13 | 0 | 1.76/4400 |
| J | 3.1/5.0 | 3 | 38 | 4 | 14 | 0 | 1.72/4300 |
| K | 2.2/3.7 | 4 | 56 | 0 | 14 | 0 | 2.32/5800 |
| L | 2.6/4.2 | <1 | 53 | 8 | 14 | 0 | 1.08/2700 |

In Table 1, both the FSSS (Fisher Sub-Sieve Sizer) particle size and the $D_{50}$ particle size (mass median diameter) are shown. Samples A, D to H, and K are examples of preferred embodiments of the present invention, while samples B, C, I, J, and L are comparative examples. Sample C contains Dy in an amount of 1 at. %, while the other samples contain no Dy.

The pulverizing conditions for obtaining the respective powder samples are as shown in Table 2 below.

TABLE 2

| | Pulverizing/classifying condition | |
|---|---|---|
| Sample | Feed rate (g/min) | Classifying rotor (rpm) |
| A | 15 | 7500 |
| B | 60 | 5000 |
| C | 60 | 5000 |
| D | 15 | 7500 |

TABLE 2-continued

| | Pulverizing/classifying condition | |
|---|---|---|
| Sample | Feed rate (g/min) | Classifying rotor (rpm) |
| E | 20 | 7000 |
| F | 30 | 6500 |
| G | 40 | 6000 |
| H | 50 | 5500 |
| I | 55 | 5300 |
| J | 60 | 5000 |
| K | 20 | 7000 |
| L | 100 | 3500 |

Fine powder having the particle size distribution according to preferred embodiments of the present invention is obtained by adopting a relatively slow velocity for feeding the raw material and increasing the rotational speed of the classifying rotor.

Figure 3:
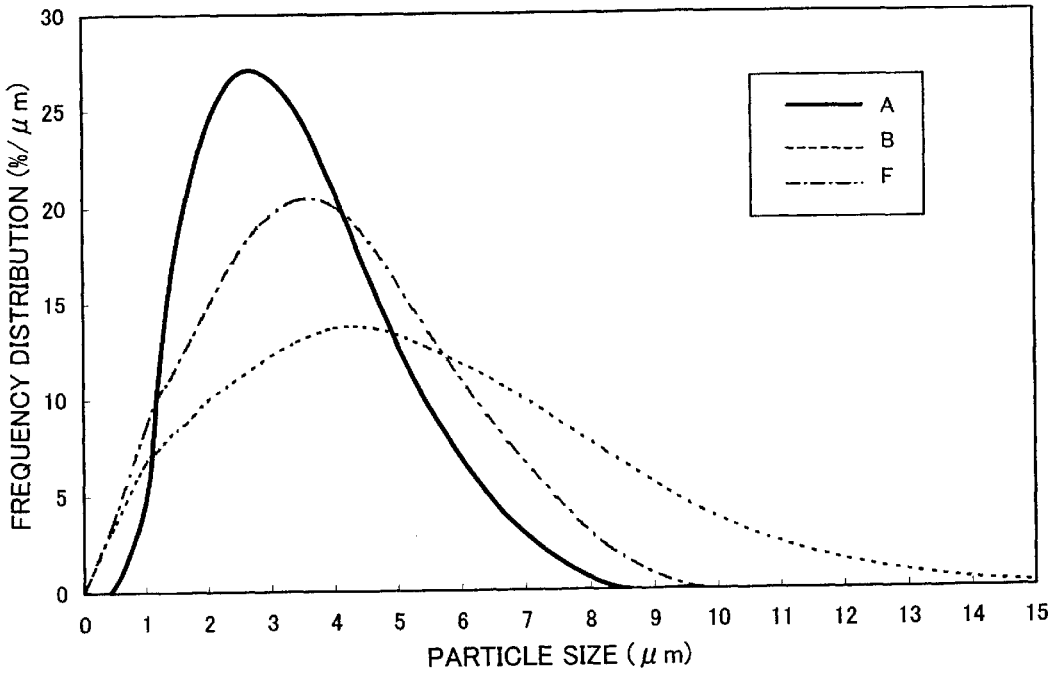
FIG. 3 is a graph showing the powder particle size distributions of samples A, B, and F measured by a light scattering method using a Fraunhofer forward scattering.

FIG. 3 is a graph showing the particle size distributions of samples A, B, and F, measured by the light scattering method using a Fraunhofer forward scattering. The particle size distributions of samples A and F as examples of preferred embodiments of the present invention are sharp, compared with that of sample B as a comparative example. In samples A and F, particles having a size in the range of about 2.0 $\mu$m to about 5.0 $\mu$m occupy approximately 45 vol. % or more and moreover particles having a size larger than about 10 $\mu$m occupy less than approximately 1 vol. %. In sample B, particles having a size in the range of about 2.0 $\mu$m to about 5.0 $\mu$m occupy approximately 38 vol. % and particles having a size larger than about 10 $\mu$m occupy approximately 4 vol. %.

Figure 4:
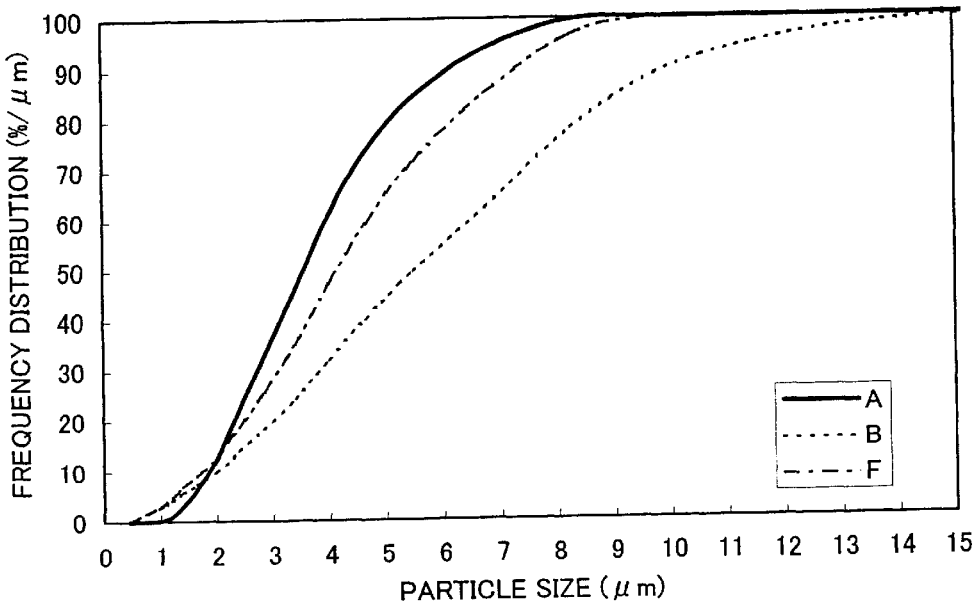
FIG. 4 is a graph showing the frequency distributions of powder particles of samples A, B, and F, prepared based on the measurement data shown in the graph of FIG. 3.

FIG. 4 is a graph showing frequency distributions of powder of samples A, B, and F. The particle size ($D_{50}$) at which the accumulated frequency reaches about 50% is about 3.2 $\mu$m in sample A and about 3.8 $\mu$m in sample F, while it is as large as about 5.0 $\mu$m in sample B. These values of the particle size correspond to about 2.1 $\mu$m, about 2.4 $\mu$m, and about 3.1 $\mu$m, respectively, in the FSSS particle size.

The powder samples A to L were compacted to produce compacts having approximate dimensions of 15 mm×15 mm×15 mm. The pressure applied was about 100 MPa. During the compaction, a magnetic field (about 0.8 MA/m)

for alignment was applied in a direction that is substantially perpendicular to the pressing direction. After the compaction, the compact was sintered in an argon atmosphere. The sintering conditions are as shown in Table 3 below.

TABLE 3

| Sample | Sintering condition: Temperature retained (° C.) | Sintering condition: Duration (Hour) |
|---|---|---|
| A | 1020 | 4 |
| B | 1040 | 4 |
| C | 1040 | 4 |
| D | 1020 | 4 |
| E | 1020 | 4 |
| F | 1030 | 4 |
| G | 1040 | 4 |
| H | 1040 | 4 |
| I | 1040 | 4 |
| J | 1040 | 4 |
| K | 1020 | 4 |
| L | 1040 | 4 |

The resultant sintered magnets of samples A to L were evaluated for crystal grain size, the oxygen concentration, the magnetic properties, and the density. The results are shown in Table 4 below.

TABLE 4

| Sample | Sintered body: Grain size Average grain size (μm) | Composition Oxygen amount (at %/ppm) | Magnetic Properties: Br (T) | HcJ (kA/m) | (BH)max (kJ/m³) | Density (g/cc) |
|---|---|---|---|---|---|---|
| A | 5.1 | 3.00/7500 | 1.32 | 1178.1 | 313.6 | 7.55 |
| B | 8.0 | 2.00/5000 | 1.35 | 907.4 | 339.1 | 7.57 |
| C | 8.0 | 2.00/5000 | 1.35 | 1178.1 | 342.3 | 7.57 |
| D | 5.1 | 3.00/7500 | 1.32 | 1178.1 | 313.6 | 7.55 |
| E | 5.4 | 2.80/7000 | 1.35 | 1082.6 | 347.1 | 7.56 |
| F | 6.5 | 2.60/6500 | 1.34 | 1003.0 | 339.1 | 7.56 |
| G | 7.0 | 2.40/6000 | 1.34 | 987.0 | 343.9 | 7.56 |
| H | 7.5 | 2.20/5500 | 1.34 | 971.1 | 343.1 | 7.56 |
| I | 7.7 | 2.12/5300 | 1.35 | 923.4 | 338.3 | 7.56 |
| J | 8.0 | 2.00/5000 | 1.35 | 907.4 | 339.1 | 7.57 |
| K | 5.4 | 2.80/7000 | 1.35 | 1082.6 | 347.1 | 7.56 |
| L | 13.2 | 1.32/3300 | 1.38 | 875.6 | 359.8 | 7.53 |

The oxygen amount in Table 4 represents the oxygen amount in the sintered magnet measured in the following manner. The sintered magnet is pulverized into powder having a particle size in the range of several tens to several hundreds of micrometers in an inert atmosphere. The resultant powder is placed in a carbon crucible equipped with electrodes, and heated to about 3000° C. while current is applied. This allows oxygen atoms (O) in the magnet to react with carbon atoms (C) in the crucible, generating CO and $CO_2$ gas. The generated gas is guided to pass through an infrared absorption detector, where the infrared transmittance of the gas is measured to determine the gas concentration (oxygen concentration). For this measurement of the oxygen concentration, a measuring apparatus (EMGA-620W) manufactured by Horiba, Ltd. was used. The length of intercepts was measured from a photograph of a section of the sintered body (photograph of a polished face) using an image analysis apparatus. The measured mean intercept length was multiplied by 1.5 times, and the resultant value was determined as the "average crystal grain size".

Figure 5:
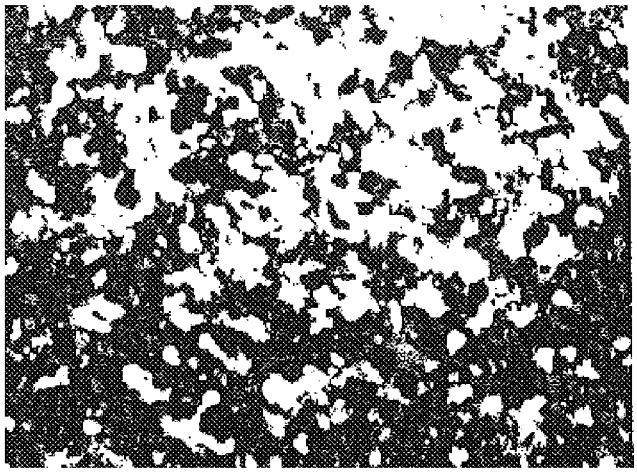
FIG. 5 is a microphotograph (640×) showing the crystal structure of a sintered magnet produced from the powder of sample A.
Figure 6:
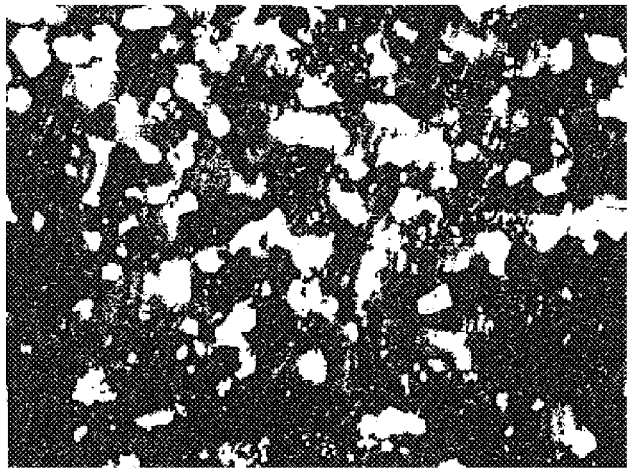
FIG. 6 is a microphotograph (640×) showing the crystal structure of a sintered magnet produced from the powder of sample B.
Figure 7:
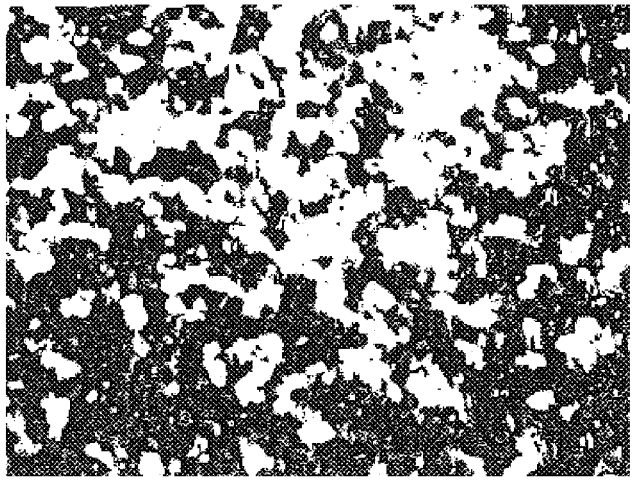
FIG. 7 is a microphotograph (640×) showing the crystal structure of a sintered magnet produced from the powder of sample F.

Microphotographs (640×) showing the crystal structures of the sinter magnets produced from the powder of samples A, B, and F, among others, are shown in FIGS. 5, 6, and 7, respectively. The length of 6.4 mm in these microphotographs corresponds to 10 μm of the real sintered magnets.

As is apparent from Table 4, the sintered magnets of the examples of preferred embodiments of the present invention, which preferably have an average crystal grain size in the range of about 5 μm to about 7.5 μm and an oxygen concentration in the range of about 2.2 at. % to about 3.0 at. %, are far superior in magnetic properties to those of the comparative examples having a particle size distribution outside the above-described range (excluding sample C). Sample C exhibits magnetic properties as excellent as those of the examples of preferred embodiments of the present invention. The reason is that Dy contained in sample C contributes to the improvement of magnetic properties. In other words, the sintered magnet according to preferred embodiments of the present invention, which does not contain expensive Dy, can provide magnetic properties as excellent as the magnetic properties obtainable when Dy is added in an amount of about 1 at. %. This greatly reduces the manufacturing cost and help save Dy, which is one of precious natural resources.

Since the rare earth alloy powder particles used in preferred embodiments of the present invention are ferromagnetic, they tend to agglomerate together with a magnetic force, forming secondary aggregated particles or cohering particles. For this reason, the measurement results may not be correct when a conventional particle size distribution measurement method is used. In this example, therefore, the particle size distribution was measured in the following manner.

While a strong gas flow is applied to a sample cell to keep powder particles inside from agglomerating together, the sample cell is irradiated with a laser beam emitted from a laser source of a particle size measuring apparatus to effect high-speed scanning of the sample cell. Changes in the intensity of the laser beam that has passed through the sample cell are detected, and based on the detection results, the particle size distribution of particles dispersed in the sample cell is measured. This particle size distribution measurement can be performed using a particle size distribution measuring apparatus (HELOS Particle Size Analyzer) manufactured by SYMPATEC, for example. The amount of transmitted light decreases when the laser beam is blocked by a particle during the high-speed scanning. Using this fact, the above particle size distribution measuring apparatus directly determines the particle size from the time required for the laser beam to pass over a particle.

The present invention was described as being applied to a rapidly solidified alloy produced by a strip casting method. However, possible applications of the present invention are not limited to this type of alloy. R-rich superfine powder is also formed when an alloy produced by an ingot method is used. Therefore, the effects and advantages of the present invention are also exhibited for this case.

According to various preferred embodiments of the present invention, powder that is uniform in particle size and finer than conventional ones is used. Moreover, the oxygen concentration of the powder is appropriately adjusted to achieve significant advantages. As a result, deterioration in magnet properties caused by oxidation of a rare earth element R is sufficiently prevented, and thus the magnet properties such as the coercive force can be greatly improved. In addition, safety in the magnet manufacturing process is significantly improved.

The present invention exhibits significant effects especially when a rapidly solidified alloy (for example, a strip cast alloy) that tends to generate R-rich super-fine powder is used and when the hydrogen pulverization process is executed.

While the present invention has been described with respect to preferred embodiments thereof, it will be apparent to those skilled in the art that the disclosed invention may be modified in numerous ways and may assume many embodiments other than those specifically described above. Accordingly, it is intended that the appended claims cover all modifications of the invention that fall within the true spirit and scope of the invention.

What is claimed is:

1. An R—Fe—B rare earth magnet having an average crystal grain size in a range of about 5 $\mu$m to about 7.5 $\mu$m, and an oxygen concentration in a range of about 2.2 at. % to about 3.0 at. %.

2. The R—Fe—B rare earth magnet of claim 1, wherein alloy powder as a material of the R—Fe—B rare earth magnet contains substantially no Dy.

* * * * *